US006966098B2

(12) United States Patent
Sako et al.

(10) Patent No.: US 6,966,098 B2
(45) Date of Patent: Nov. 22, 2005

(54) CLEANER

(75) Inventors: Yukinobu Sako, Katano (JP); Masuo Ota, Katano (JP); Akihiko Kotani, Ikoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 336 days.

(21) Appl. No.: 10/374,138

(22) Filed: Feb. 27, 2003

(65) Prior Publication Data

US 2004/0168281 A1 Sep. 2, 2004

(51) Int. Cl.[7] ..... A47L 5/00; A47L 5/30
(52) U.S. Cl. ..... 15/364; 15/4; 15/231; 15/403
(58) Field of Search ..... 15/4, 41.1, 43, 15/51, 52, 49.1, 231, 363, 364, 393, 403, 15/228

(56) References Cited

U.S. PATENT DOCUMENTS

| | | | | |
|---|---|---|---|---|
| 2,064,903 | A * | 12/1936 | Ghignatti | 15/396 |
| 6,305,046 | B1 * | 10/2001 | Kingry et al. | 15/231 |
| 6,783,600 | B2 * | 8/2004 | Tawara et al. | 134/6 |
| 6,859,976 | B2 * | 3/2005 | Plankenhorn | 15/380 |
| 2002/0194693 | A1 * | 12/2002 | Wu | 15/322 |
| 2003/0204923 | A1 * | 11/2003 | Nakamura | 15/4 |
| 2004/0045126 | A1 * | 3/2004 | Parker et al. | 15/403 |
| 2004/0134016 | A1 * | 7/2004 | Kisela et al. | 15/320 |
| 2004/0134025 | A1 * | 7/2004 | Murphy et al. | 15/403 |
| 2004/0139572 | A1 * | 7/2004 | Kisela et al. | 15/320 |
| 2004/0250376 | A1 * | 12/2004 | Hori et al. | 15/403 |
| 2005/0076468 | A1 * | 4/2005 | Matousek et al. | 15/403 |

FOREIGN PATENT DOCUMENTS

| | | | |
|---|---|---|---|
| EP | 1027855 | * | 8/2000 |
| JP | 6377423 | | 4/1988 |
| JP | 09253017 | | 9/1997 |
| JP | 10314096 | | 12/1998 |

OTHER PUBLICATIONS

English Language Abstract of JP. Appln. No. 10-314096.
English Language Translation of Claim 1, for JP. Appln. No. 63-77423.
English Language Abstract of JP. Appln. No. 09-253017.

* cited by examiner

*Primary Examiner*—Terrence R. Till
(74) *Attorney, Agent, or Firm*—Greenblum & Bernstein, P.L.C.

(57) ABSTRACT

A cleaner is provided which includes an electric dirt collection mechanism with an electrically powered dirt collection action and a wiping cleaning mechanism with a wiping cleaning action utilizing a cleaning sheet provided on the bottom surface of the main body of the cleaner which moves across the floor, wherein the electric dirt collection mechanism is switched on and off using a switch, and the wiping cleaning mechanism can be attached to, or detached from, the main body.

9 Claims, 11 Drawing Sheets

CLEANER

The present disclosure relates to subject matter contained in Japanese Patent Application No. 2001-337673, filed on Nov. 2, 2001, the contents of which is herein expressly incorporated by reference in its entirety.

BACKGROUND OF THE INVENTION

1. Field of the Invention

The present invention relates to a cleaner which exhibits a cleaning function which utilizes a rotating brush or a suction device, and another cleaning function which utilizes a cleaning sheet.

2. Description of Related Art

Electric cleaners are widely used for cleaning floors in most typical households. On the other hand, Japanese Patent Laid-Open Publication No. Hei 10-314096 discloses a light weight cleaning tool which is easy to operate and enables any noticeable dirt to be cleaned with less effort than would be required with an electric cleaner. This cleaning tool utilizes a disposable cleaning sheet which is mounted to a holder, and by using a wiping action, dirt is collected on the surface of the cleaning sheet. Furthermore, Japanese Patent Laid-Open Publication No. Sho 63-77423 discloses a small electric cleaner with good ease of operation. This cleaner uses a battery driven rotating brush which sweeps up and collects any dirt.

The cleaning tool with a cleaning sheet collects dirt by capturing the dirt within the fibers of the sheet, which is formed from a nonwoven fabric or the like, and is consequently very effective in removing hair and dust. Furthermore, the sheet will also absorb liquids. However, the collection and removal of comparatively large pieces of dirt such as breadcrumbs, or comparatively heavy pieces of dirt such as sand is difficult.

In contrast, the rotating brush cleaner is very effective in removing heavy pieces of dirt such as breadcrumbs or sand. However, the removal of very fine dirt particles or soiling such as dust, and the removal of liquids is difficult.

Consequently, neither the aforementioned cleaning tool nor the cleaner are able to provide adequate cleaning of a wide range of dirt, soiling and liquids.

SUMMARY OF THE INVENTION

In light of the above, an object of the present invention is to provide a cleaner which deals with a wide range of dirt, soiling and liquids by employing two types of cleaning functions.

A cleaner of the present invention includes a cleaning function which utilizes either a rotating brush or a suction fan driven by an electric power supply, and another cleaning function which utilizes a cleaning sheet.

While novel features of the invention are set forth in the preceding, the invention, both as to organization and content, can be further understood and appreciated, along with other objects and features thereof, from the following detailed description and examples when taken in conjunction with the attached drawings.

DETAILED DESCRIPTION OF THE PREFERRED EMBODIMENTS

As follows is a more detailed description of two preferred embodiments of the present invention, based on FIG. 1 through FIG. 16. These embodiments are merely representative examples of the present invention, and in no way restrict the invention.

(First Embodiment)

Figure 11:
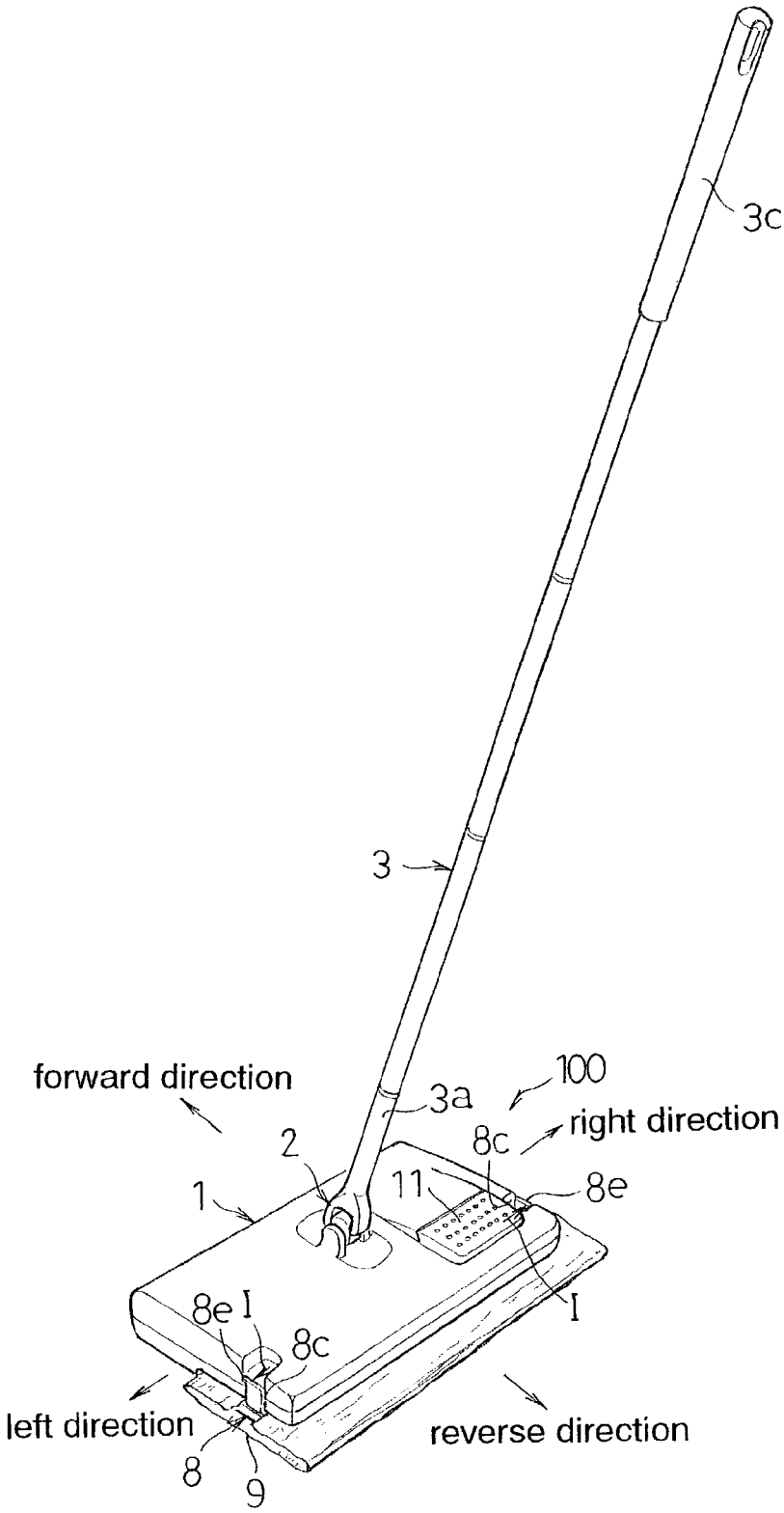
FIG. 11 is a perspective view showing the entire cleaner according to the first embodiment of the invention.

FIG. 11 shows the overall construction of a cleaner 100 according to a first embodiment. As shown in the figure, the cleaner 100 has a main body 1, and a handle 3 which is connected via a universal joint 2 to a substantially central position on the upper surface of the main body 1. By operating the handle 3, the main body 1 can be moved across the floor in any of the forward, reverse, left, and right directions shown in FIG. 1 and FIG. 11. Furthermore, by twisting the handle 3 to the right, the main body 1 turns towards the right via the universal joint 2, and by twisting the handle 3 to the left, the main body 1 turns towards the left via the joint 2. The handle 3 is divided into five sections along the length of the handle, and these sections are connected together via screws or the like, so that the handle can be disconnected at any of the connections between these sections. A base section 3*a* connected to the main body 1 cannot be detached, in order to ensure a stable connection to the main body 1. The base section 3*a* is made shorter than the other sections of the handle, so as not to protrude beyond the edges of the main body 1 when laid down along the lengthwise direction of the main body 1. A grip 3*c* is provided at the free end of the handle 3, and with the exception of the base section 3*a*, all the sections of the handle are of the same length, so that when the sections are disconnected, the sections can be easily bundled together.

As shown in FIG. 1 through FIG. 5, the main body 1 houses a rotating brush 4, a portion of which faces out from the bottom surface near the front edge of the main body 1, a motor 5 which drives the rotating brush 4, and a power supply 6 which supplies power to the motor 5. A dust collection case 7 which can be attached to, or detached from, the bottom surface of the main body 1 is housed immediately behind the rotating brush 4. A cleaning sheet mounting member 8 for mounting a cleaning sheet 9 is provided on the bottom surface near the rear of the main body 1, and can be attached to, or detached from, the bottom surface of the main body 1. By employing the above construction, the cleaner exhibits an electric brush cleaning function using the rotating brush 4, and a non-electric sheet cleaning function using the cleaning sheet 9.

Figure 1:
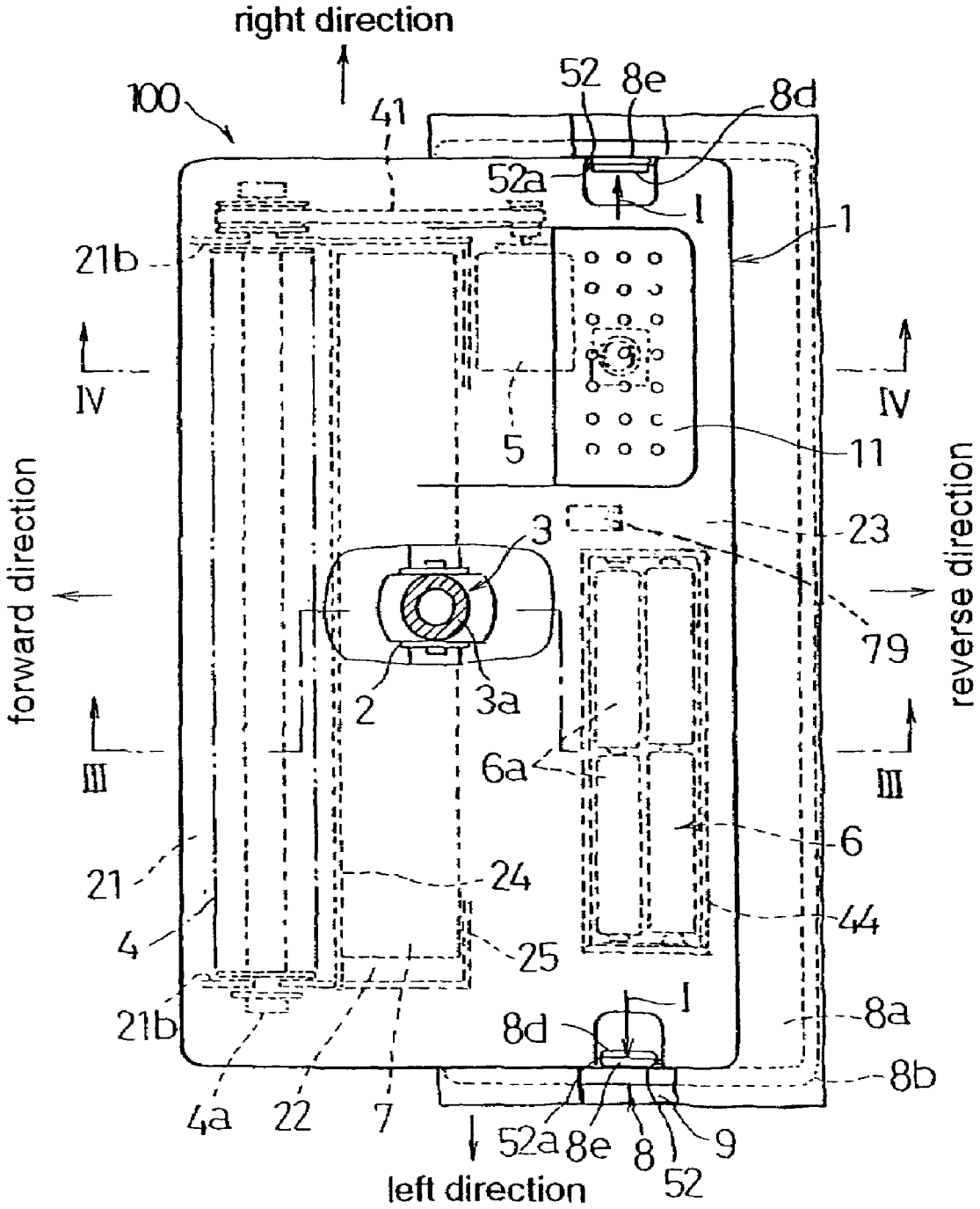
FIG. 1 is a plan view of the main body of a cleaner according to a first embodiment of the present invention.

Selection as to whether or not the rotating brush 4 is used, is made by switching the motor 5 on or off via a switch key 11 provided on the upper surface of the main body 1, as shown in FIG. 1. In contrast, selection as to whether or not the cleaning sheet 9 is used, is made by attaching or detaching the cleaning sheet mounting member 8 with the cleaning sheet 9 either to, or from, the main body 1. Consequently, the cleaner can be applied to a wide range of cleaning tasks, including the removal of heavier dirt particles such as breadcrumbs or sand, the removal of fine dirt or soiling such as hair or dust, and the removal of liquids. If the rotating brush 4 is rotated while a cleaning sheet 9 is also mounted to the cleaner, then the two different cleaning functions described above can be selected simultaneously, enabling the various types of dirt, soiling and liquids to be removed in a single action.

Figure 3:
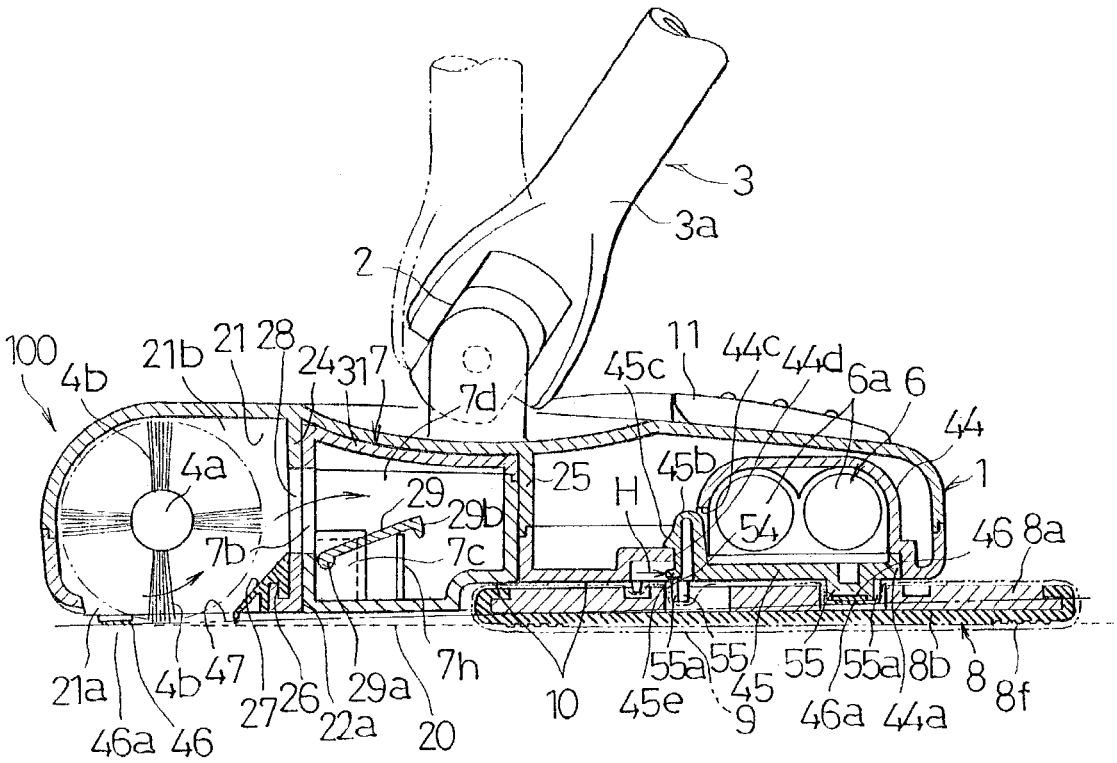
FIG. 3 is a cross-sectional view of the main body, taken along the line III—III in FIG. 1.
Figure 4:
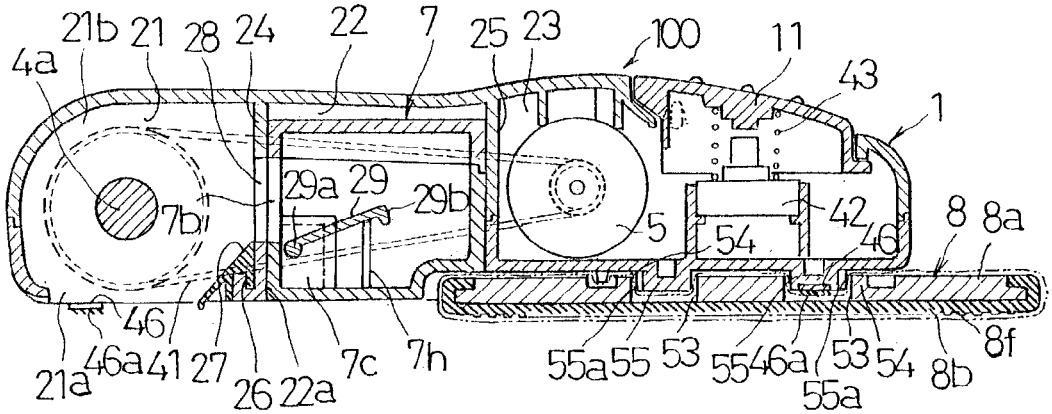
FIG. 4 is a cross-sectional view of the main body, taken along the line IV—IV in FIG. 1.
Figure 5:
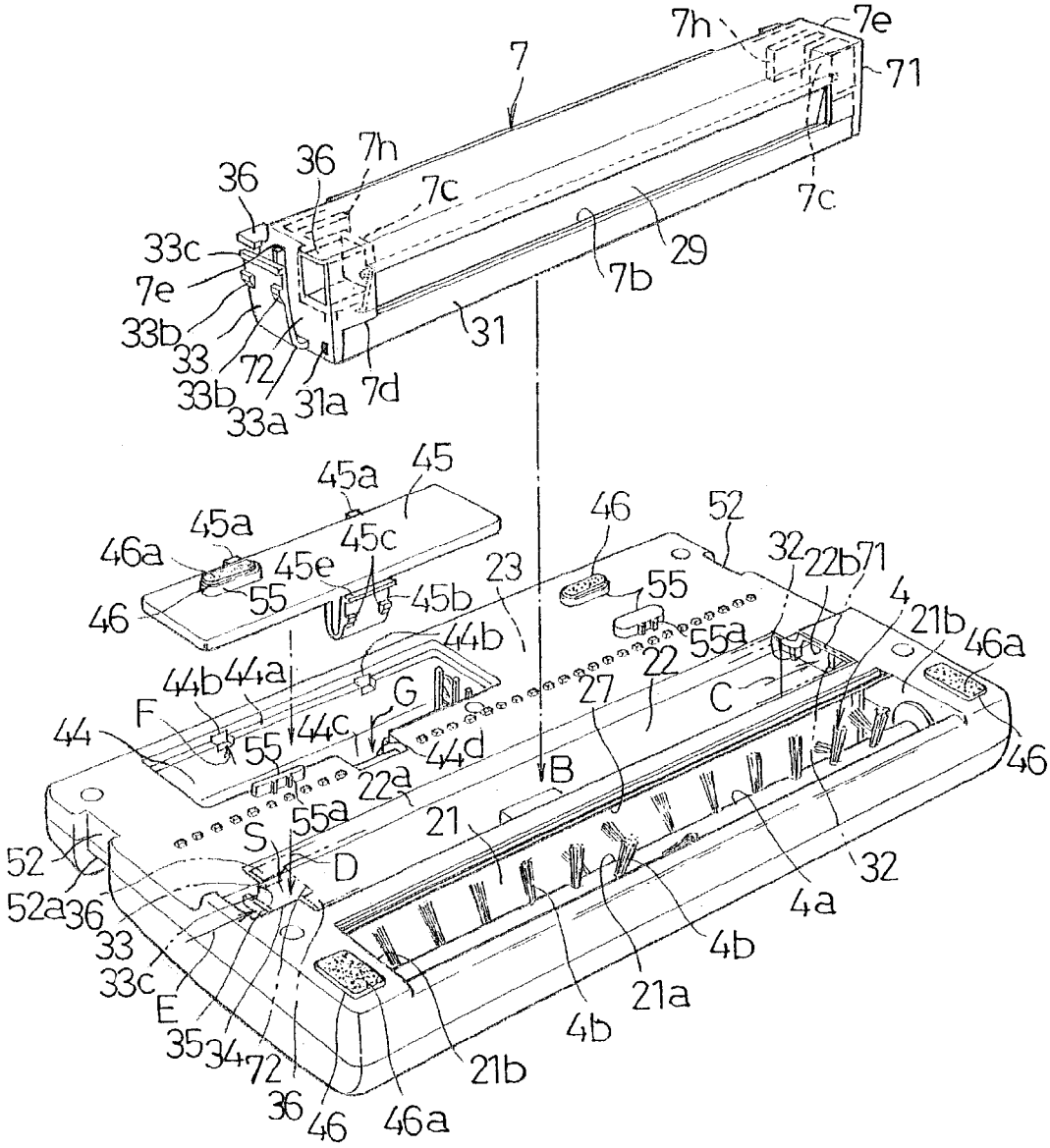
FIG. 5 is a perspective view of the cleaner shown in FIG. 1, with the bottom surface of the main body facing upwards, and the lid of a battery chamber and a dust collection case detached and lifted out of the main body.

The main body 1 is made of a synthetic resin, and includes a hollow case produced by fitting an upper and a lower member together and then securing the two members with screws or the like, as shown in FIG. 3 and FIG. 4. The inside of the main body 1 is partitioned into a brush chamber 21, a dust collection chamber 22, and an electrical chamber 23, from the front to the rear respectively, and partitioning walls 24, 25 are provided between each of the chambers. As shown in FIG. 1, FIG. 3 and FIG. 5, the left and right side walls 21*b*, 21*b* of an opening 21*a* in the brush chamber 21 support the rotational shaft 4*a* of the rotating brush 4, so that the rotating brush 4 is able to rotate in a position facing partially out from the bottom surface of the main body 1. In this manner, when the main body 1 is moved across a floor surface, the rotating bristles 4*b* of the rotating brush 4 sweep across the floor surface, sweeping up any dirt. A dust collection guide 27 formed of an elastic body such as rubber is fitted into a concavo-convex engagement section 26 provided at the rear edge of the opening 21*a* of the brush chamber 21, as shown in FIG. 3 and FIG. 4. The dirt swept up by the action described above is scooped up by this dust collection guide 27 and guided towards the dust collection chamber 22. The partitioning wall 24 between the brush chamber 21 and the dust collection chamber 22 includes a dust collection port 28 shown in FIG. 3 and FIG. 4, and dirt guided up the dust collection guide 27 is fed through this port and into the dust collection chamber 22. The dust collection guide 27 is designed to improve the dirt collection efficiency of the dust collection chamber 22 for dirt swept up by the rotating brush 4, without unnecessarily complicating the form of the main body 1.

The bristles 4*b* are embedded in bundled tufts at various positions around the circumferential surface of the rotational shaft 4*a*. The tufts of bristles 4*b* are aligned in helical patterns, these helical patterns are spaced equally at three or four positions around the circumference of the rotational shaft 4*a*. The pitch between adjacent tufts of bristles is set so that all of the bristles 4*b* work in a cooperative action, sweeping the floor surface with essentially no gap across the width of the cleaner, but without any substantial overlap. As a result, even if the pitch between tufts of bristles is large, unswept dirt residues are not left on the floor, and even comparatively large pieces of dirt such as paper scraps are entrapped by the tufts of bristles 4*b* and then swept up and into the cleaner by the inherent strength of the bristles. Furthermore, when the rotating brush 4 is not in use, one of the tufts of bristles 4*b* contacts the floor surface, and the tufts positioned on either side thereof nearly contact the floor surface, whereas the other tufts have absolutely no contact with the floor or dirt. Accordingly, the bristles do not obstruct the wiping cleaning action of the cleaning sheet 9, and are unaffected by any soiling or liquids.

As shown in FIG. 3, FIG. 4, and FIG. 5, the dust collection chamber 22 houses and supports the dust collection case 7 in a manner which enables the case 7 to be detached from the underside of the main body 1 via an opening 22*a* provided in the bottom surface of the main body 1. The dust collection case 7 is a rod shaped hollow case with a substantially rectangular lateral cross-section, and includes a dirt inlet 7*b* which communicates with the dust collection port 28 when the case is inserted in the dust collection chamber 22. Consequently, dirt which has been passed through the dust collection port 28 and into the dust collection chamber 22 is received via this dirt inlet 7*b* and collected in the dust collection case 7. The dirt inlet 7*b* is provided with a check valve 29 such as that shown in FIG. 3, FIG. 4, and FIG. 5, which prevents the collected dirt from spilling out through the dirt inlet 7*b*. The check valve 29 is a synthetic resin plate type member of a sufficient size to seal the dirt inlet 7*b* when in contact with the inside surface of the dirt inlet 7*b*. The check valve 29 includes an integrated shaft 29*a* which protrudes out from the left and the right sides at the bottom edge of the check valve 29, when viewed in the state shown in FIG. 3 and FIG. 4. This shaft 29*a* is supported in the internal left and right side walls 7*c*, 7*c* of the dirt inlet 7*b* in a manner which enables the shaft to rotate. The shaft 29*a* has a diameter which is slightly larger than the thickness of the check valve 29, and by forming a reinforcing rib 29*b* which bends inwards along the top edge of the check valve 29, the flexural rigidity of the check valve 29 in a lengthwise direction is improved.

When the dust collection case 7 is in the dust collection state, the check valve 29 is not stable in an upward pointing position which closes off the dirt inlet 7*b*, and rotates inwards about the shaft 29*a*, opening the dirt inlet 7*b*. As a result, provided the dust collection case 7 is inserted inside the main body 1, and the main body 1 is in the cleaning state shown in FIG. 3 and FIG. 4, then the check valve 29 is positioned with the dirt inlet 7*b* open, enabling dirt to be collected inside the dust collection case 7. The open position of the check valve 29 is restricted by stopper walls 7*h* provided inside the dust collection case 7, as shown in FIG. 3 and FIG. 4, and so the check valve 29 adopts an inclined position with a rising gradient towards the internal edge of the valve. As a result, the check valve 29 forms a substantially continuous incline in combination with the dust collection guide 27, and collected dirt is guided to a position in approximately the cross-sectional center of the internal space of the dust collection case 7, and is then released and allowed to settle inside the dust collection case 7. At this point, the dirt can circulate around underneath the check valve 29, thereby increasing the accumulation storage capacity inside the dust collection case 7. Furthermore, when in this position, the check valve 29 exhibits a non-return function which suppresses the reverse flow of collected dirt in the dust collection case 7 back out through the dirt inlet 7*b*. As shown in FIG. 5, the stopper walls 7*h* extend out from the left and right side walls 7*e* of the dust collection case 7 only far enough to contact the ends of the check valve 29, and do not prevent dirt from circulating around underneath the check valve 29.

By removing the dust collection case 7 from the main body 1, the collected dirt can be handled independently from the main body 1, and transported, disposed of, or cleaned. Accordingly, the handling operation is simpler than a case in which the collected dirt must be handled within the main body 1, and the dust collection chamber 22 and the dust collection case 7 are easier to keep clean. Since the dust collection case 7, including the check valve 29, is transparent, the state of the collected dirt is checked visually, enabling the time for dirt disposal to be determined. Furthermore, when the dust collection case 7 is removed with dirt contained therein, the state of the dirt and the state of the check valve 29 are checked easily, dirt is prevented from spilling from the dust collection case 7, and the dirt is disposed of with ease.

In order to remove the dust collection case 7 from the main body 1, the main body 1 is inverted so that the opening 22*a* of the dust collection chamber 22 is facing upwards, as shown in FIG. 5. At this point, the dust collection case 7 is still inserted inside the main body 1 as shown by the virtual line (i.e., two dot chain line) in the figure. Consequently, because the dust collection case 7 is inverted together with the main body 1, the check valve 29 is also inverted. As a result, the check valve 29 rotates spontaneously about the shaft 29*a* to the most stable downward facing position, as shown by the solid lines in the FIG. 5, thereby closing the dirt inlet 7*b*, and preventing the collected dirt from spilling. This action provides a non-return valve function, enabling the dust collection case 7 removed from the main body 1, shown by the solid lines in FIG. 5, to be handled with the collected dirt still contained therein. Furthermore if transported, the check valve 29 prevents the dirt from spilling out.

Figure 6:
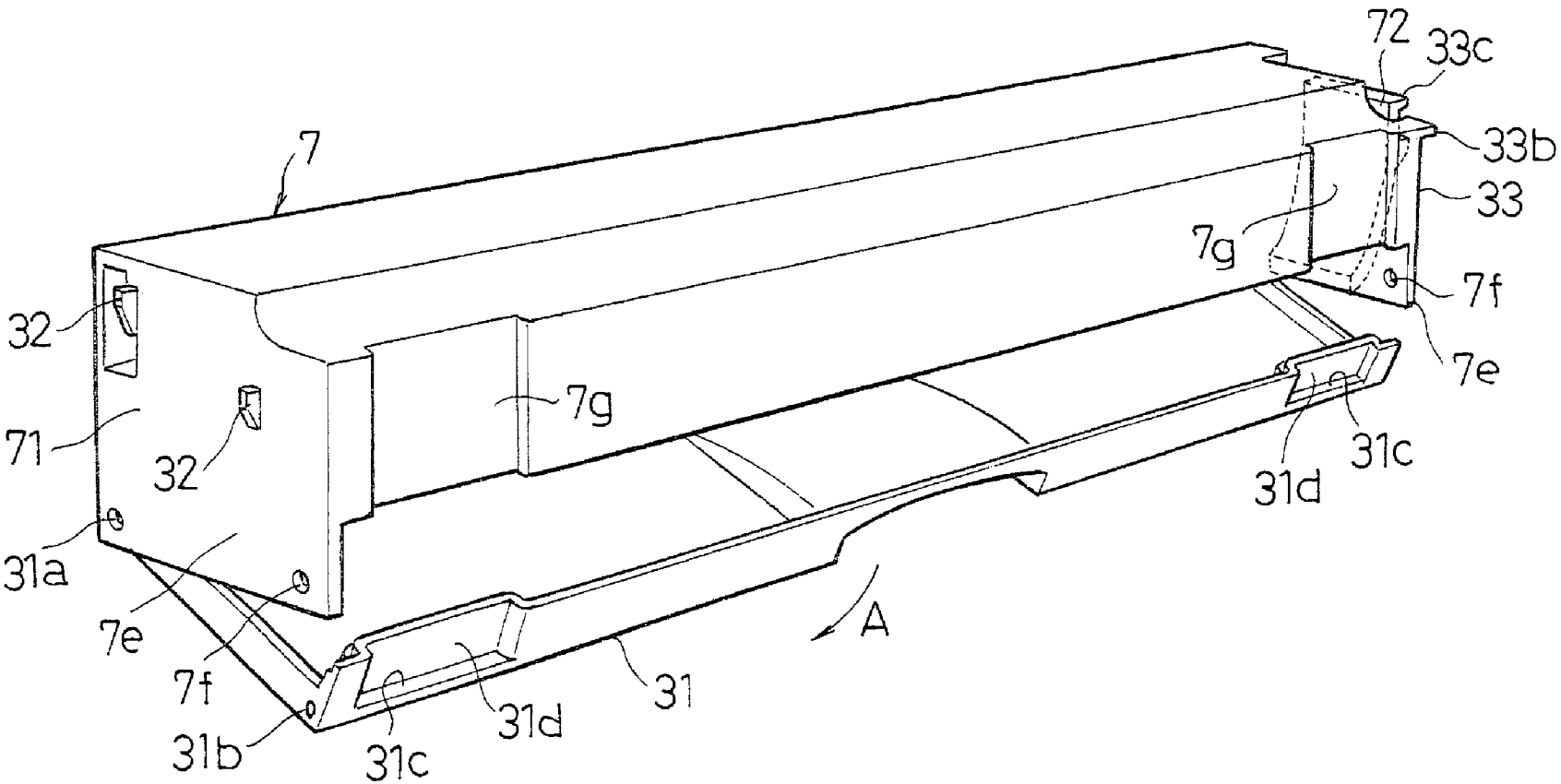
FIG. 6 is a perspective view showing the lid of the dust collection case in an open state for ejecting collected dirt.

In order to eject collected dirt, the dust collection case 7 has an ejection port 7*d* which is opened and closed by a lid 31 positioned on top of the dust collection case 7 in the state shown in FIG. 3 and FIG. 4. The lid 31 constitutes one portion of the dust collection case 7, and is made of a transparent synthetic resin. As shown in FIG. 5 and FIG. 6, the lid 31 fits inside the left and right walls 7*e* of the ejection port 7*d*, and the front and rear walls of the lid engage with the front and rear walls of the dust collection case 7 across the ejection port 7*d*, closing the ejection port 7*d* as shown in FIG. 5. The lid 31 includes an integrated shaft 31*a* which protrudes outward at the left and the right sides of the dirt inlet 7*b*, and this shaft 31*a* is supported in the left and right side walls 7*e* of the ejection port 7*d* in a manner which enables the shaft to rotate. Consequently, the lid 31 is opened and closed by rotating about this shaft 31*a*. FIG. 6 shows the lid 31 in a slightly opened state. The lid 31 includes small dome shaped projections 31*b* on the left and right sides at the free edge of the lid, at the opposite side to the base edge including the shaft 31*a*. In the closed state shown in FIG. 5, these projections 31*b* engage elastically with engagement apertures 7*f* provided in the left and right side walls 7*e* of the dust collection case 7, by utilizing the resin spring characteristics of the left and right side walls 7*e*. This engagement action secures the lid 31 in the closed state, preventing any unintentional opening of the lid.

However, this engagement between the projections 31*b* and the engagement apertures 7*f* can be released by moving the free edge of the lid 31 in the direction of the arrow A shown in FIG. 6, and by then opening the lid 31 an adequate distance and exposing the ejection port 7*d*, the collected dirt is ejected. Due to the nature of this opening operation for the lid 31, finger catches 31*c* are provided in the rear wall, on the free edge side of the lid 31. These finger catches 31*c* are provided on both the left and right sides of the lid, and are generated by forming indented concave sections 7*g* and 31*d* which extend vertically along the rear wall of the dust collection case 7 and the lid 31 respectively, forming a portion of the edge of the lid 31.

When removed from the main body 1, the dust collection case 7 is positioned with the ejection port 7*d* facing downward and the check valve 29 closed, as shown in FIG. 5, and by handling the case in this orientation, any collected dirt is prevented from spilling out. At the dirt disposal site, with the dust collection case 7 still in the same orientation, if the ejection port 7*d* is then exposed by opening the lid 31 by the opening operation shown in FIG. 6, then the ejection port 7*d* will be facing downwards, enabling the dirt to be ejected. The dust collection case 7 opens along the entire length providing a straight path to the ejection port 7*d*, and the stopper walls 7*h* are also aligned in the same direction, meaning on ejection, dirt cannot become trapped and remain within the case.

The dust collection case 7, including the lid 31, has a body of a size which is slightly shorter than the length of the opening in the dust collection chamber 22, but has almost no play across the width of the opening. The dust collection case 7 is engaged in the direction of the arrow B shown in FIG. 5. At this point, one body end 71 of the case engages with one end of the opening of the dust collection chamber 22 with no play. The other body end 72 engages with the other end of the opening of the dust collection chamber 22 with a level of play S, as shown by the virtual line or two dot chain line in the figure. Specifically, with the body end 71 held against the end of the opening of the dust collection chamber 22 in the direction of the arrow C, engagement protrusions 32, 32 shown in FIG. 6, which are provided as an integral section of the body end 71, engage with inward facing engagement edges 22*b* formed at the end of the opening of the dust collection chamber 22, as shown by the virtual line or two dot chain line in FIG. 5, and the other body end 72 is then engaged in the direction of the arrow D.

At this point, an engagement piece 33, which is formed as an integral section of the body end 72 is inserted into the play S via a connecting section 33*a* which connects the engagement piece 33 to the body end 72, and engages inside a concave section 34 at the end of the opening of the dust collection chamber 22. At the final stage of this engagement of the body end 72 in the direction of the arrow D, engagement protrusions 33*b* at the free end of the engagement piece 33 engage elastically with an inward facing engagement edge 35 formed at the top edge of the concave section 34, by utilizing the resin spring characteristics of the engagement piece 33. This engagement action, in combination with the engagement of the engagement protrusions 32 and the engagement edge 22*b*, secures the dust collection case 7 inside the dust collection chamber 22, in other words an inserted state, thereby preventing any unintentional detachment of the dust collection case 7.

The free end of the engagement piece 33 functions as an operation section 33*c* and protrudes even further outwards than the engagement protrusions 33*b*. By using this operation section 33*c* to push the engagement piece 33 in the direction of the arrow E, the engagement protrusions 33*b* are disengaged from the engagement edge 22*b*, and the dust collection case 7 is removed. The dust collection case 7 cannot be removed without performing this operation.

In addition, the body end 72 of the dust collection case 7 also has integrated protrusions 36, 36 at two positions at the front and the rear of the dust collection case 7. In the engaged state described above, they oppose the ends of the opening of the dust collection chamber 22 with almost no play therebetween, thereby removing the lengthwise play between the dust collection case 7 and the dust collection chamber 22 across the opening 22*a*. Furthermore, these protrusions 36, 36 and the engagement protrusions 32, 32 on the body end 71 cause the dimensions of the dust collection case 7 in the lengthwise direction to exceed the lengthwise dimensions of the opening 22*a* in the dust collection chamber 22. As a result, if an attempt is made to insert the dust collection case 7 into the dust collection chamber 22 with the left and right hand ends reversed, then the protrusions 36, 36 and the engagement protrusions 32, 32 will interfere with the opening 22*a* of the dust collection chamber 22 making insertion impossible. Accordingly, misuse of the cleaner resulting from insertion of the dust collection case 7 with the left and right ends reversed, or breakage of the engagement piece 33 arising from forced engagement of the dust collection case 7 with the left and right ends reversed, is prevented.

Furthermore, when the dust collection case 7 is engaged in the dust collection chamber 22, the ejection port 7*d* and the lid 31 are housed internally, within the dust collection chamber 22, as shown in FIG. 3 and FIG. 4. As a result, the lid 31 can only be opened and the ejection port 7*d* only exposed when the dust collection case 7 is removed from the dust collection chamber 22. Consequently, opening of the dust collection case 7 while the case is inserted inside the dust collection chamber 22 and spillage of the collected dirt is not possible. However, in order to satisfy this requirement, the ejection port 7*d* and the lid 31 of the dust collection case 7 need not necessarily be housed inside the dust collection chamber 22. Provided insertion of the dust collection case 7 into the dust collection chamber 22 causes opening of the lid 31 to be impeded by interference or contact with the dust collection chamber 22 or the main body 1, then any construction is suitable. In addition, the cleaning sheet mounting member 8 is mounted to the bottom surface of the main body 1, in a position towards the rear of the main body 1 behind the rotating brush 4, in a position which does not impede cleaning at the front of the main body 1 using the rotating brush 4. However, the cleaning sheet mounting member 8 extends from a region behind the dust collection case 7 to a section which overlaps with the dust collection case 7. In the figures, the cleaning sheet mounting member 8 covers a portion of the dust collection case 7, and this overlap means that the dust collection case 7 cannot be removed from the main body 1 unless the cleaning sheet mounting member 8 is first detached from the main body 1.

As shown by the dashed lines in FIG. 1, the electrical chamber 23 extends from the rear of the dust collection chamber 22 around both sides of the dust collection chamber 22 and the brush chamber 21. The aforementioned motor 5 is positioned to the right hand side of the electrical chamber 23 behind the dust collection chamber 22, and the motor 5 and the rotational shaft 4*a* of the rotating brush 4 are connected via a belt 41, shown in FIG. 1 and FIG. 4, by utilizing the space within the electrical chamber 23 which extends along the right hand side of the dust collection chamber 22 and the brush chamber 21, whereby the rotating brush 4 is driven by the motor 5. A switch 42 for turning the motor 5 on and off is provided in a position beneath the aforementioned switch key 11 of the electrical chamber 23, as shown in FIG. 1 and FIG. 4. The switch key 11 is maintained in a raised position by a spring 43, and when the switch key 11 is pressed from above, the switch 42 is pressed and activated, and each time the switch key is pressed, the switch 42 cycles through an on-off repeating cycle.

Figure 10:
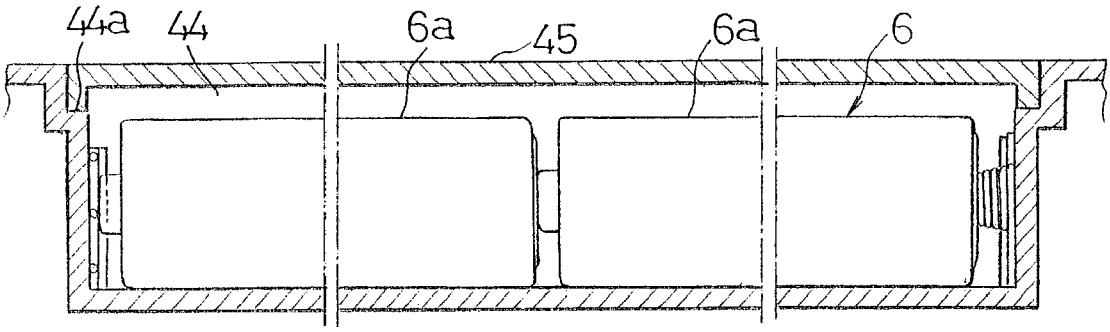
FIG. 10 is a cross-sectional view of the battery chamber shown in FIG. 9.

A battery box 44 which houses the batteries 6*a* to function as the power supply 6, is provided within the remaining space of the electrical chamber 23, on the opposite side to the location of the motor 5 and the switch 42, as shown in FIG. 1. As shown in FIG. 3, FIG. 5, FIG. 9, and FIG. 10, the battery box 44 is formed as an integral section of the main body 1, and opens on the bottom surface of the main body 1. In the example shown in the figures, four batteries 6*a* are connected in series in two rows, although the housing arrangement and the connection of the batteries is arbitrary. A stepped section 44*a* is formed around the opening of the battery box 44, and engages with a removable battery lid 45, as shown in FIG. 3, FIG. 5, and FIG. 10, thereby forming a flush bottom surface with the main body 1.

In order to achieve this engagement, the battery lid 45 includes integral engagement protrusions 45*a*, 45*a* formed on the left and right sides along the rear edge of the lid 45 in a lengthwise direction, and a U shaped engagement piece 45*b*. The U shaped engagement piece 45*b* protrudes down inside the battery box 44 and is integrated with the lid through a connection at the base to approximately the center of the front edge of the lid. Accordingly, the opening of the battery box 44 includes engagement apertures 44*b* into which the engagement protrusions 45*a*, 45*a* are inserted and engaged, in the direction of the arrow F shown in FIG. 5, a notch 44*c* into which the engagement piece 45*b* is inserted in the direction of the arrow G, and an engagement edge 44*d* with which engagement protrusions 45*c* at the free end of the engagement piece 45*b* engage elastically, utilizing the resin spring characteristics of the engagement piece 45*b*, when the battery lid 45 is fully closed within the notch 44*c*. The combination of the engagement between these engagement protrusions 45*a*, 45*a* and the engagement apertures 44*b*, and the engagement between the engagement protrusions 45*c* and the engagement edge 44*d*, secures the battery lid 45 in a closed state, preventing any unintentional detachment of the lid. The engagement between the engagement protrusions 45*c* of the engagement piece 45*b* and the engagement edge 44*d* is released by pushing an operation section 45*e* provided at the free end of the engagement piece 45*b* in the direction of the arrow H shown in FIG. 3. By releasing this engagement, the front edge of the battery lid 45 is lifted up from the opening of the battery box 44, and if the engagement protrusions 45*a*, 45*a* are subsequently lifted out of the engagement apertures 44*b*, the battery lid 45 is removed.

In this example, pads 46 with densely packed bristles 46*a* are provided on the bottom surface of the main body 1, on the left and right sides near the front of the main body, and on the left and right sides near the rear of the main body, as shown in FIG. 5. The surface of the bristles of these four pads 46 are essentially aligned with the tip of the aforementioned dust collection guide 27 and a coplanar surface 47 shown by the virtual line or two dot chain line in FIG. 3, and function as a guide surface for enabling stable movement of the main body 1 across the floor surface when the cleaning sheet 9 is not mounted. As shown in FIG. 3 and FIG. 5, one of the pads 46 is provided on the battery lid 45. However, the positioning of the pads 46 is not restricted to this particular arrangement. The tip of the dust collection guide 27 protrudes marginally through the coplanar surface 47 and is pressed against the floor surface.

Figure 2:
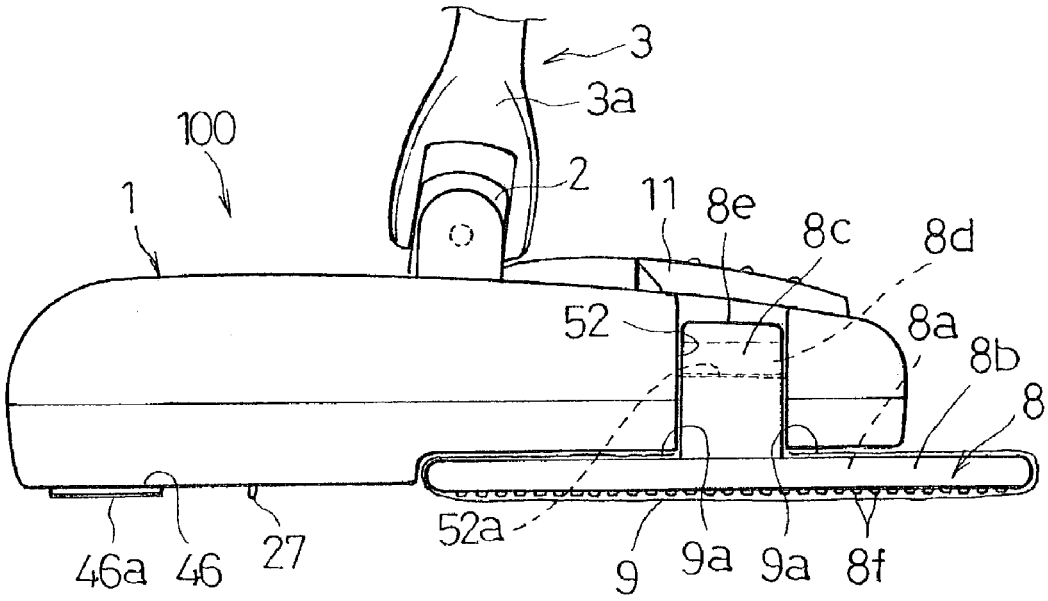
FIG. 2 is a side view of the main body of the cleaner.

As shown in FIG. 1 and FIG. 2, a cleaning sheet 9 is wrapped around the base plate 8*a* of the cleaning sheet mounting member 8, which is then mounted onto the main body 1. When the handle 3 is then used to move the main body 1 across the floor surface, the cleaning sheet 9 wrapped around the base plate 8*a* wipes and cleans the floor surface. The cleaning sheet 9 is preferably a micro fiber material such as that disclosed in Japanese Patent Laid-Open Publication No. Hei 9-253017. The material disclosed in this publication is prepared using a mixed fiber material of conifer kraft pulp, short fiber rayon, thermoplastic resin, and fusible polyester, which is converted to a sheet by a typical wet paper method. Furthermore, a sheet which has been heat embossed with an embossing roller with a fine irregular pattern is even more desirable. Using such an embossed sheet enables dust to be wiped up very effectively. Furthermore, the micro fibers, which are even finer than hair, enable even long, fine objects such as hairs to be captured with a single wiping motion. In addition, the use of this type of cleaning sheet 9 in combination with a moisture absorbent is also disclosed, although this technique is not employed in the first embodiment.

In the first embodiment, in the region on the bottom surface of the main body 1 which corresponds with the position of the cleaning sheet mounting member 8, a portion at the rear of the bottom surface of the dust collection case 7 is formed as a slightly indented concave surface 10. As a result, the cleaning sheet 9, which is attached to the main body 1 via the cleaning sheet mounting member 8, and the surface of the bristles of the pads 46 on the bottom surface of the main body 1 are aligned along a coplanar surface 20 shown by a dashed line in FIG. 3, and function as a guide surface for enabling stable movement of the main body 1 across the floor surface when the cleaning sheet 9 is being used. In this example, the two guide surfaces of the main body 1, represented by the coplanar surfaces 47, 20, are inclined relative to each other along the forward-reverse direction, with the origin of each guide surface positioned at the surface of the bristles 46*a* of the pads 46 on the bottom surface, at the front end of the main body 1.

Figure 7:
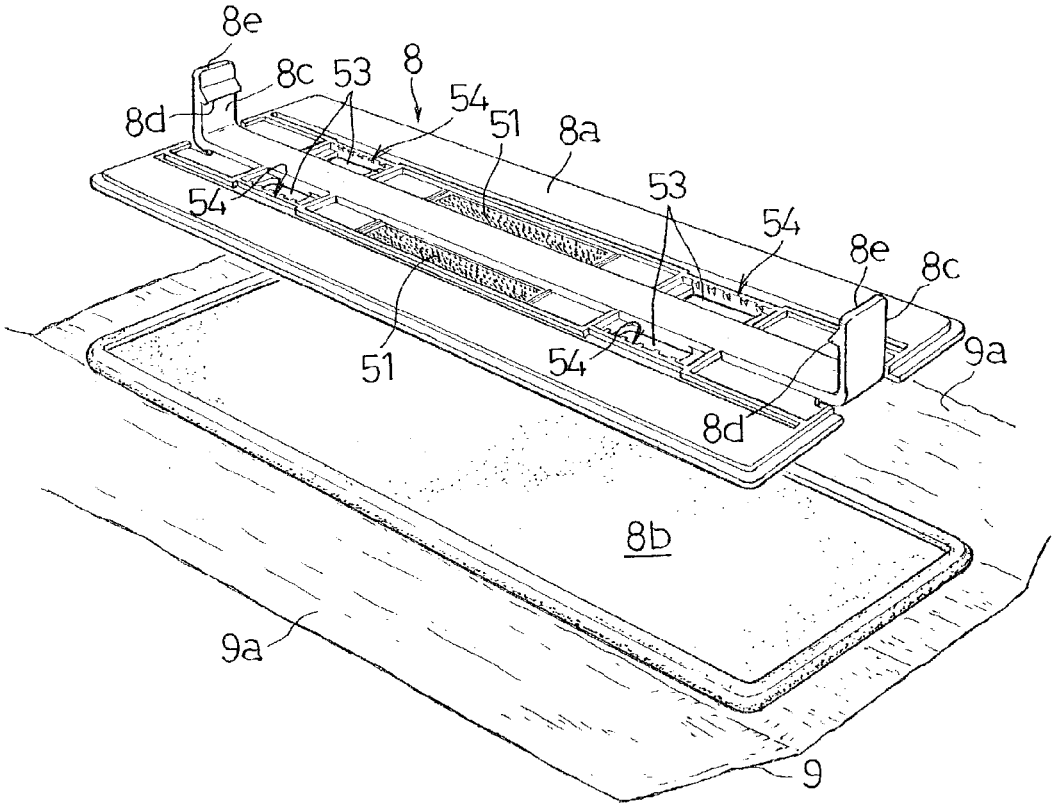
FIG. 7 is an exploded perspective view showing a cleaning sheet mounting member.
Figure 8:
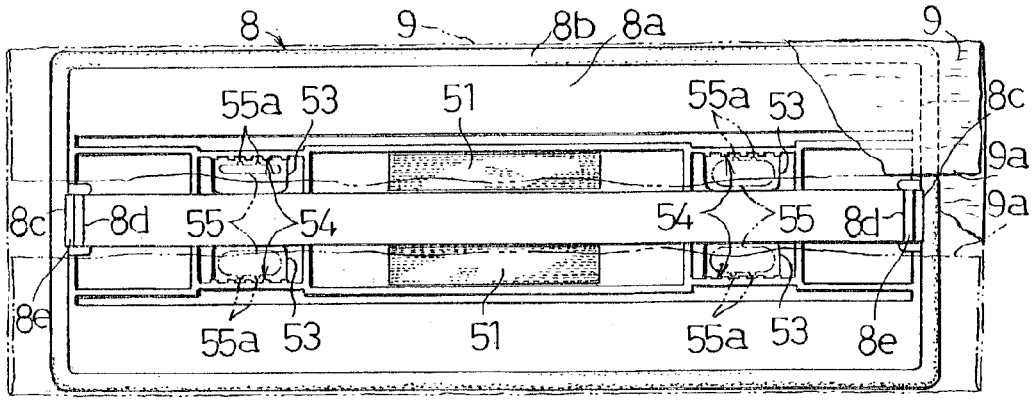
FIG. 8 is a plan view of the cleaning sheet mounting member.
Figure 9:
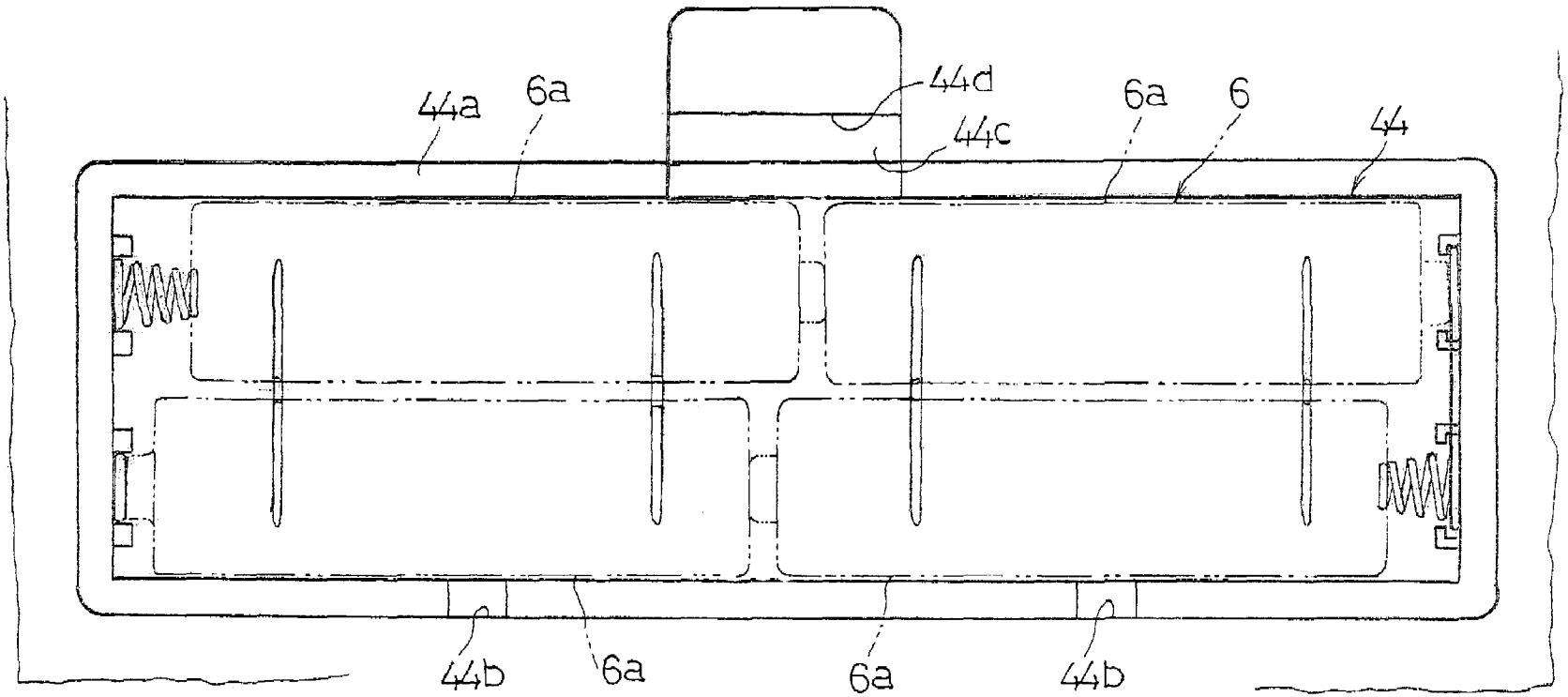
FIG. 9 is a bottom view showing the battery chamber of the main body shown in FIG. 3, with the lid removed.

In order to wrap the cleaning sheet 9 around the base plate 8*a*, the base plate 8*a* is provided with surface fasteners 51 at the front and the rear, in substantially the center of the upper surface of the base plate, as shown in FIG. 7 and FIG. 8. These surface fasteners 51 are formed, for example, by cutting a loop pile of a resin filament yarn to form a multitude of hooks. By bringing the cleaning sheet 9 into contact with these surface fasteners 51 and pressing gently, the fibers of the cleaning sheet 9 become caught by the hooks on the surface fasteners 51, securing the cleaning sheet 9. The sheet is secured particularly strongly in the in-plane direction. Accordingly, by bringing the cleaning sheet 9 into contact with the bottom of an elastic cover 8*b*, which covers the lower surface of the base plate 8*a*, so that the cleaning sheet 9 is substantially centered beneath the elastic cover 8*b*, subsequently folding both widthwise edges 9*a*, 9*a* of the sheet up and over the top of the base plate 8*a*, and then bringing these edges into contact with the surface fasteners 51, as shown by the virtual line or two dot chain lines in FIG. 8, the cleaning sheet 9 can be secured in the type of wrapped state shown in FIG. 1, FIG. 2 and FIG. 11.

In order to mount the cleaning sheet mounting member 8, around which the cleaning sheet 9 is wrapped, to the main body 1, upward facing engagement pieces 8*c* such as those shown in FIG. 7 are formed as integral sections at the left and right edges of the synthetic resin base plate 8*a*. Each of these engagement pieces 8*c* has an inward facing engagement protrusion 8*d* at the tip thereof, and when the base plate 8*a* is brought in contact with upward facing, inverted bottom surface of the main body 1 shown in FIG. 5, these engagement protrusions 8*d* are forced out while engaging with concave sections 52 provided on the left and right edges at the rear of the main body 1, utilizing the resin spring characteristics of the engagement protrusions 8*d*. During this engagement between the engagement pieces 8*c* and the concave sections 52, at the point that the base plate 8*a* contacts the bottom surface of the main body 1, the engagement protrusions 8*d* of the engagement pieces 8*c* engage elastically with corner sections 52*a* formed between the concave sections 52 and the upper surface of the main body 1. This action enables the cleaning sheet 9 to be mounted in a usable state such as that shown in FIG. 1, FIG. 2, FIG. 3, FIG. 4, and FIG. 11, without any unintentional detachment of the cleaning sheet mounting member 8.

When the main body 1 is moved across the floor surface with the cleaning sheet 9 in this mounted state, the elastic cover 8*b* on the lower surface of the base plate 8*a* presses the cleaning sheet 9 elastically against the floor surface with a substantially even pressure across the entire surface, thereby improving the wiping cleaning performance. Furthermore, a multitude of protrusions 8*f* such as those shown in FIG. 2, FIG. 3, and FIG. 4 are formed in a crisscross pattern across the lower surface of the elastic cover 8*b*. As a result, the cleaning sheet 9 contacts the floor surface with no clearance at the portions corresponding with the protrusions 8*f*, but with a slight clearance allowed at those portions between the protrusions 8*f*. At this point, the combination of the contact with the floor surface and the very slight lift provided by the aforementioned irregular surface of the cleaning sheet 9 enables dirt particles such as dust and hairs to be captured within the entire area between the cleaning sheet 9 and the floor surface, making capture and retention of these dirt particles by the micro fibers easier. As a result, a very effective wiping cleaning action is achieved, utilizing essentially the entire area of the cleaning sheet 9 which contacts the floor surface.

The engagement between the engagement pieces 8*c* and the corner sections 52*a* when the cleaning sheet mounting member 8 is mounted onto the main body 1 can be released by pushing operation sections 8*e* provided at the free end of the engagement pieces 8*c* in the direction of the arrows I shown in FIG. 1 and FIG. 11. By releasing this engagement, the cleaning sheet mounting member 8 and the cleaning sheet 9 is removed from the main body 1. Once the cleaning sheet mounting member 8 has been removed from the main body 1, the cleaning sheet 9 is removed from the mounting member 8, and the used sheet is then disposed of, and replaced with a new sheet.

Apertures 53 such as those shown in FIG. 7 and FIG. 8 are formed to the left and the right of each of the surface fasteners 51 provided at the front and the rear on the upper surface of the base plate 8*a*. Catches 54 including an alignment of fine protrusions are formed along the front edge of the front apertures 53 and along the rear edge of the rear apertures 53, with these protrusions protruding into the respective apertures 53. Protrusions 55 which fit into these apertures 53 when the cleaning sheet mounting member 8 is mounted are provided in positions on the bottom surface of the main body 1 corresponding with the apertures 53, as shown in FIG. 3, FIG. 4, and FIG. 8. The protrusions 55 include a plurality of ribs 55*a* which oppose the catches 54.

The edges 9*a*, 9*a* of the cleaning sheet 9 wrapped around the base plate 8*a* are positioned over the region in which these apertures 53 and protrusions 55 fit together, as shown by the virtual line or two dot chain lines in FIG. 8, and these edges 9*a* are pulled into the gaps in these fittings, as shown by the virtual line or two dot chain lines in FIG. 3 and FIG. 4. As a result, the cleaning sheet 9 is subjected to a tensioning action which increases the strength with which the sheet is wrapped around the base plate 8*a*, pulling the sheet tightly onto the elastic cover 8*b* and preventing any slipping. In particular, the edges 9*a* pulled into the gaps in the concavo-convex fittings formed by the apertures 53 and the protrusions 55 are pushed against the catches 54 of the apertures 53 by the ribs 55*a* of the protrusions 55, maintaining the tensioned state of the cleaning sheet 9, and preventing any slipping. The apertures 53 may also be concave sections. Furthermore, the apertures 53 or concave sections, and the protrusions 55 can be provided on either of the main body 1 and the cleaning sheet mounting member 8. By employing a securing mechanism for the cleaning sheet 9 using this type of concavo-convex engagement, the surface fasteners 51 are no longer a necessity, and no other extra components or operations are required for securing the cleaning sheet 9, thereby reducing production costs, and simplifying the mounting operation.

(Second Embodiment)

FIG. 12 through FIG. 16 show a second embodiment of the present invention. This second embodiment differs from the first embodiment only in the provision of a suction fan 61 shown in FIG. 12 through FIG. 15 instead of the rotating brush of the first embodiment. Accordingly, those members in common with the first embodiment are labeled with the same symbols, and any duplication within the figures or the description is omitted.

Figure 12:
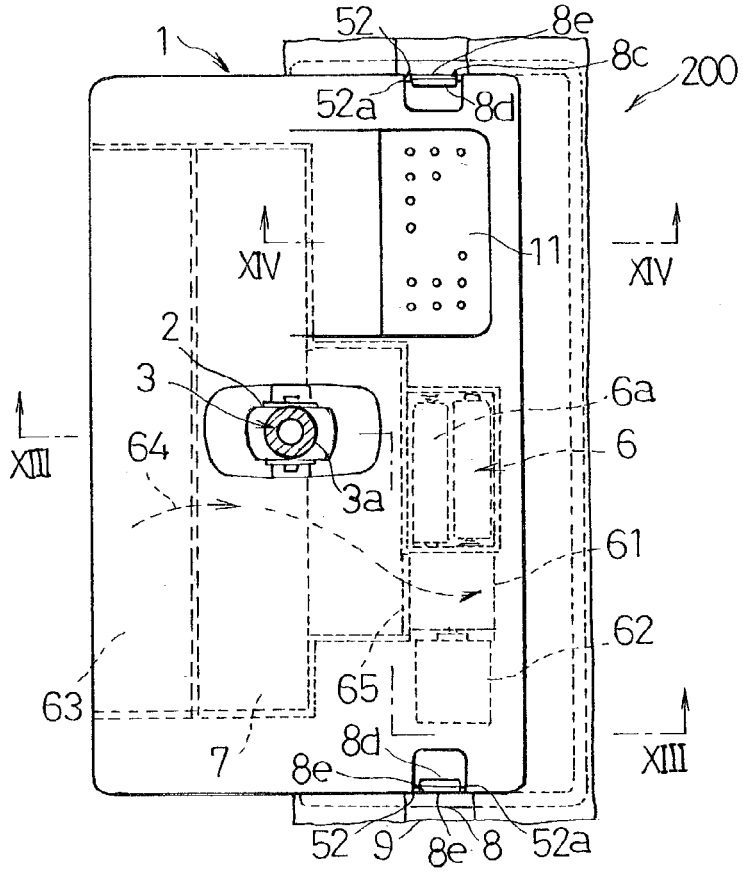
FIG. 12 is a plan view of the main body of a cleaner according to a second embodiment of the invention.
Figure 13:
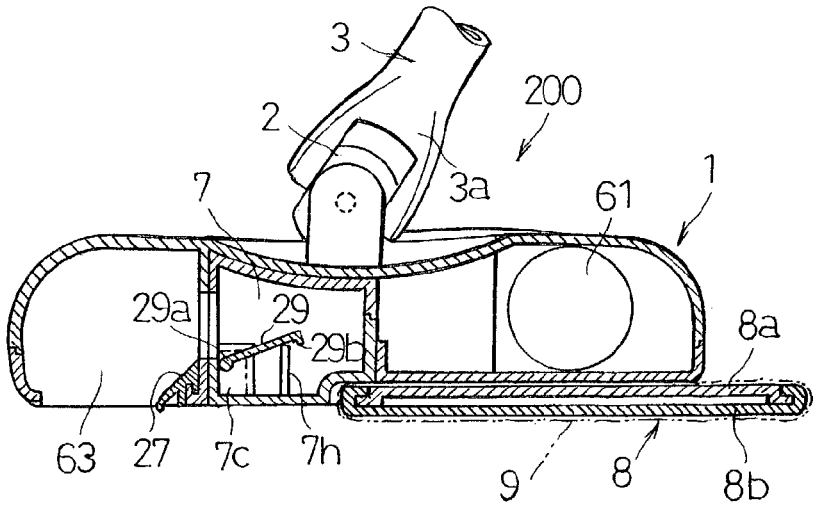
FIG. 13 is a cross-sectional view of the main body of the cleaner, taken along the line XIII—XIII in FIG. 12.

As shown in FIG. 12, the suction fan 61 and a fan motor 62 which drives the fan 61 are provided, together with the power supply 6 and the dust collection case 7, inside the main body 1, which is operated by the handle 3. The suction fan 61 applies suction via a suction opening 63 shown in FIG. 12 and FIG. 13 which opens into the bottom surface near the front of the main body 1, and draws air through the dust collection case 7 positioned to the rear of the suction opening 63, in the direction of the dashed arrow shown in FIG. 12. Dirt carried by this suction air stream 64 is separated out by a filter 65 inside the dust collection case 7, and collected inside the case 7. In addition, in a similar manner to the first embodiment, a cleaning sheet 9 is mounted to a cleaning sheet mounting member 8 which can be detached from the bottom surface at the rear of the main body 1, in a position separated from the suction opening 63 so as not to impair the suction cleaning function, but with a partial overlap with the dust collection case 7. As a result, a cleaner 200 is constructed which exhibits a suction cleaning function which utilizes the suction fan 61, and another cleaning function which utilizes the cleaning sheet 9.

Selection as to whether or not the suction fan 61 is used, is made by switching the fan motor 62 on or off by a switch key 11 provided on the upper surface of the main body 1, as shown in FIG. 12. In contrast, selection as to whether or not the cleaning sheet 9 is used, is made by attaching or detaching the cleaning sheet mounting member 8 with the cleaning sheet 9 either to, or from, the main body 1. Consequently, the cleaner can be applied to a wide range of cleaning tasks, including the removal of heavier dirt particles such as breadcrumbs or sand, the removal of fine dirt or soiling such as hair or dust, and the removal of liquids. If the suction fan 61 is operated while a cleaning sheet 9 is also mounted to the cleaner, then the two different cleaning functions described above can be selected simultaneously, enabling the various types of dirt, soiling and liquids to be removed in a single action.

Figure 14:
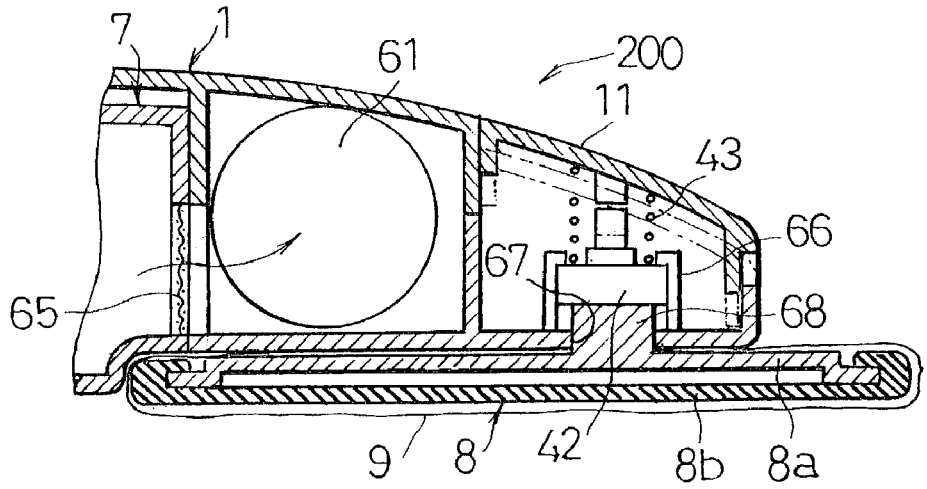
FIG. 14 is a partial cross-sectional view of the main body, taken along the line XIV—XIV in FIG. 12.
Figure 15:
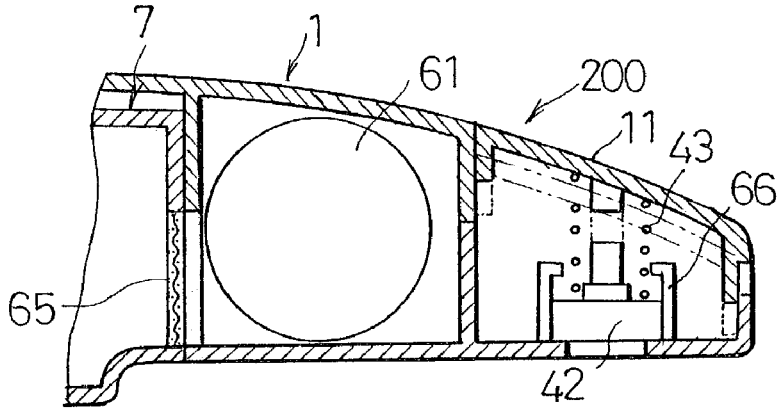
FIG. 15 is a partial cross-sectional view of the main body, showing a state in which the cleaning sheet mounting member and the cleaning sheet have been removed from the state shown in FIG. 14.

In the second embodiment, the switch 42 shown in FIG. 14 and FIG. 15 which opposes the switch key 11 is supported in a manner which enables up and down movement within a guide 66 provided inside the main body 1. The spring 43 which operates between the switch key 11 and the switch 42 is energized to maintain the switch key 11 in the raised position, but is also simultaneously energized to maintain the switch 42 in the lowered position. The cleaning sheet mounting member 8 has a protrusion 68 which contacts this switch 42 through an opening 67 formed in the bottom surface of the main body 1. When the cleaning sheet mounting member 8 is mounted onto the main body 1, the protrusion 68 raises the switch against the downward pressure of the spring 43, to a position where the switch can be turned on by the switch key 11, as shown in FIG. 14. However, if the mounting member 8 is not mounted to the main body 1, then as shown in FIG. 15, the switch 42 is maintained in the lowered position by the force of the spring 43, and sits at a position where the switch cannot be turned on by the switch key 11. Consequently, if the cleaning sheet mounting member 8 is not mounted, the suction fan 61 cannot be operated. Accordingly, the possibility that the cleaner could be operated without the special guide surface provided on the main body 1 in the case of the first embodiment, and without a cleaning sheet 9 attached, is prevented, thereby preventing the main body 1 from contacting the flooring material or wood directly and causing scratches.

In this manner, the second embodiment is constrained so that the suction fan 61 cannot be operated without the cleaning sheet mounting member 8 being mounted. Accordingly, the selection as to whether or not the suction fan 61 is used is only made with the cleaning sheet mounting member 8 mounted to the main body 1. Cleaning can either be performed using only the wiping cleaning function which utilizes the cleaning sheet 9, or using this wiping cleaning function in combination with the suction cleaning function which utilizes the suction fan 61.

Figure 16:
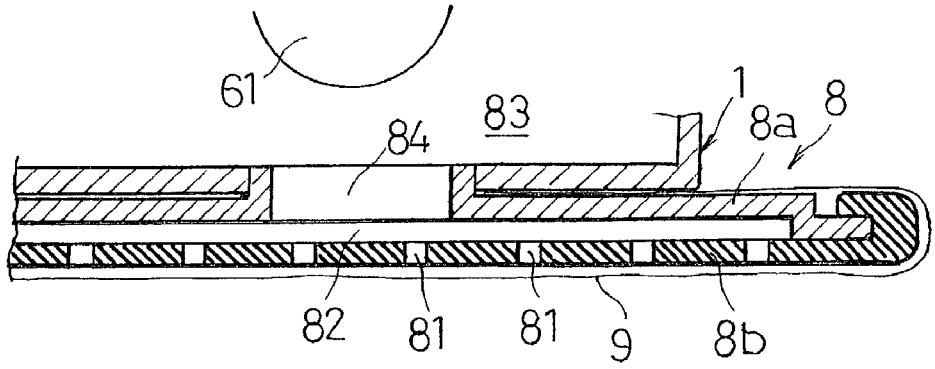
FIG. 16 is a partial enlarged sectional view of a cleaning sheet mounting member, showing a modification to the cleaner according to the second embodiment.

In the second embodiment, a modified example such as that shown in FIG. 16, in which a suction mechanism using the suction fan 61 is added to the cleaning sheet mounting member 8, is even more desirable. Specifically, small suction apertures 81 are provided across substantially the entire surface of the elastic cover 8*b*, and a suction opening 84, which connects through to a suction region 83 generated by the suction fan 61, is provided in the base plate 8*a*. The small suction apertures 81 and the suction opening 84 are connected through a cavity 82 provided between the base plate 8*a* and the elastic cover 8*b*. Accordingly, when suction cleaning using the suction fan 61 is performed, the suction from the suction fan 61 acts on the cleaning sheet 9 and the cleaning surface via the suction opening 84, the cavity 82, and the small apertures 81. As a result, dirt is suctioned onto the cleaning sheet 9, and because the sheet 9 is held tightly against the elastic cover 8*b*, slipping or wrinkling of the sheet 9 during cleaning is prevented, producing an improved cleaning effect.

In the first embodiment or the second embodiment, when the cleaning function which utilizes either the rotating brush 4 or the suction fan 61 is used in combination with the cleaning function which utilizes the cleaning sheet 9, the main body 1 is preferably moved in the forward direction. In other words, by moving the main body 1 in the forward direction, and collecting any dirt using either the rotating brush 4 or the suction action, and then wiping up any residual hairs or dust with the cleaning sheet 9, the most efficient cleaning is achieved. In the reverse direction, dirt such as breadcrumbs or sand which cannot be removed by the cleaning sheet 9 is moved along with the sheet, and never reaches the dirt collection zone of the rotating brush 4 or the suction fan 61, resulting in a reduced cleaning effect.

Accordingly, by employing a construction in which a direction sensor 79, which is schematically and non-limitingly illustrated in FIG. 1, detects the direction of movement, at least when the cleaner is moved in reverse, and stops the motor 5 or the fan motor 62, the energy of the power supply 6 is utilized more effectively, and furthermore, the operator can be alerted to the fact that the direction of operation is ineffective, thereby promoting correct use of the cleaner.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A cleaner comprising:

a main body having a handle used for operating said cleaner;

a brush cleaning mechanism provided in the main body, the brush cleaning mechanism including a rotating brush housed inside said main body and facing out from a bottom surface of the main body, a detachable dust collection case for collecting dirt swept up by said rotating brush, a motor for driving said rotating brush, a power supply for supplying power to said motor, a switch for turning said motor on and off; and a sheet cleaning mechanism including a cleaning sheet mounting member for securing a cleaning sheet to the bottom surface of the main body, the cleaning sheet mounting member being configured to attach to and detach from said main body, wherein the cleaning sheet mounting member is mounted onto the bottom surface of the main body with a cleaning sheet wrapped therearound, and cooperating convex and concave members which fit together and clamp said cleaning sheet therebetween are provided on said cleaning sheet mounting member and said main body bottom surface.

2. The cleaner according to claim 1, wherein said cleaning sheet mounting member extends from a region on said main body bottom surface spaced from said dust collection case, to a section which overlaps with said dust collection case.

3. The cleaner according to claim 1, wherein said switch is switched on only when said cleaning sheet mounting member is mounted to said main body.

4. The cleaner according to claim 1, wherein said rotating brush and said cleaning sheet are positioned at a front and a rear of said main body bottom surface respectively, and a directional sensor is provided which cuts off the power supply to said motor when said main body is operated in a reverse direction with said cleaning sheet preceding said rotating brush.

5. A cleaner comprising:

a main body having a handle used for operating said cleaner;

a suction cleaning mechanism provided in the main body, the suction cleaning mechanism including a suction fan housed inside said main body for drawing air into said main body from a suction opening provided in a bottom surface of the main body, a detachable dust collection case for collecting dirt carried on a suction air stream at a point partway along a suction path generated by said suction fan, a motor for driving said suction fan, a power supply for supplying power to said motor, a switch for turning said motor on and off; and a sheet cleaning mechanism including a cleaning sheet mounting member for securing a cleaning sheet to the bottom surface of the main body, the cleaning sheet mounting member being configured to attach to and detach from, said main body wherein the cleaning sheet mounting member is mounted onto the bottom surface of the main body with a cleaning sheet wrapped therearound, and cooperating concave and convex members which fit together and clamp said cleaning sheet therebetween are provided on said cleaning sheet mounting member and said main body bottom surface.

6. The cleaner according to claim 5, wherein said cleaning sheet mounting member includes a plurality of apertures in an elastic cover which contacts the cleaning sheet, and said apertures connect to a suction region generated by said suction fan.

7. The cleaner according to claim 5, wherein the suction opening and said cleaning sheet are positioned at a front and a rear of said main body bottom surface respectively, and a directional sensor is provided which cuts off the power supply to said motor when said main body is operated in a reverse direction with said cleaning sheet preceding said suction opening.

8. The cleaner according to claim 5, wherein said cleaning sheet mounting member extends from a region on said main body bottom surface spaced from said dust collection case, to a section which overlaps with said dust collection case.

9. The cleaner according to claim 5, wherein said switch is switched on only when said cleaning sheet mounting member is mounted to said main body.

* * * * *